US005181566A

United States Patent [19]

Barneck

[11] Patent Number: 5,181,566

[45] Date of Patent: Jan. 26, 1993

[54] SIDEPOCKET MANDREL APPARATUS AND METHODS

[76] Inventor: Michael R. Barneck, Rte. 1, Box 1538, Roosevelt, Utah 84066

[21] Appl. No.: 698,713

[22] Filed: May 10, 1991

[51] Int. Cl.[5] ..... E21B 23/03

[52] U.S. Cl. ..... 166/117.5

[58] Field of Search ..... 166/117.5, 372

[56] References Cited

U.S. PATENT DOCUMENTS

| | | | |
|---|---|---|---|
| 3,994,339 | 11/1976 | Goode et al. | 166/117.5 |
| 4,034,806 | 7/1977 | McGinn et al. | 166/117.5 |
| 4,106,564 | 8/1978 | Tausch | 166/117.5 |
| 4,146,091 | 3/1979 | Terral | 166/117.5 |
| 4,201,265 | 5/1980 | Thomason et al. | 166/117.5 |
| 4,271,902 | 6/1981 | Moore, Jr. | 166/117.5 |
| 4,333,527 | 6/1982 | Higgins et al. | 166/117.5 |
| 4,480,686 | 11/1984 | Coussan | 166/117.5 |
| 4,498,533 | 2/1985 | Johnston | 166/117.5 |
| 4,553,310 | 11/1985 | Logan | 166/117.5 X |
| 4,603,736 | 8/1986 | Moore | 166/117.5 |
| 4,673,036 | 6/1987 | Merritt | 166/117.5 |
| 4,715,441 | 12/1987 | Crawford et al. | 166/117.5 |

OTHER PUBLICATIONS

Teledyne Merla, *Sidepocket Mandrels* (U.S.A.), pp. 1-10.

*Primary Examiner*—Thuy M. Bui
*Assistant Examiner*—Frank N. Tsay
*Attorney, Agent, or Firm*—Berne S. Broadbent

[57] ABSTRACT

A sidepocket mandrel apparatus including a mandrel body formed of a resin-based material, such as, for example, fiberglass. The mandrel body defines a through-bore and an enlargement axially offset from the through-bore. A valve receiving pocket formed of a rigid material is secured within the offset enlargement of the mandrel body so as to be substantially parallel to but axially offset from said through-bore. Such pocket may, for example, be formed of stainless steel or of a composite plastic material.

The sidepocket mandrel is formed by machining a valve receiving pocket from a rigid material. The valve receiving pocket is removably secured on a substantially cylindrical molding rod, together with at least one removable mold piece, the molding rod and removable mold pieces defining a desired inner shape of the sidepocket mandrel. Fiberglass is then wound around the valve receiving pocket, molding rod, and removable mold pieces to form a fiberglass mandrel body. The molding rod and mold pieces are removed from the fiberglass mandrel body, the fiberglass is cured, and the fiberglass is thereafter machined to form threads adjacent each end of the mandrel body.

21 Claims, 4 Drawing Sheets

SIDEPOCKET MANDREL APPARATUS AND METHODS

BACKGROUND

1. The Field of the Invention

This invention relates to sidepocket mandrels for use in underground wells and, more particularly, to novel apparatus and methods for providing a lightweight, sidepocket mandrel formed largely of a drillable, non-metal material.

2. The Background Art

Underground wells are typically constructed so as to include a large pipe called the "casing" which extends into the earth the entire length of the well. The casing helps ensure the mechanical integrity of the well so as, for example, to keep oil and gas from contaminating adjacent water supplies. Perforations are provided through the casing at the levels of various zones in the earth containing oil or gas. Packers are also provided within the casing to isolate these zones from the upper portion of the well and also to isolate adjacent zones from each other.

A typical well structure also comprises a smaller pipe called the "tubing." The tubing is installed within the casing so as to pass through the packers and also extend the entire length of the well. In oil or gas producing wells, it is typically the tubing which conveys the oil or gas to the wellhead. Similarly, the tubing is commonly used to convey injection material into injection wells.

In order to permit communication between the tubing and the casing, sidepocket mandrels are installed as part of the tubing string. Each mandrel typically has a port which communicates with the casing, and an adjacent valve receiving pocket is provided for installing a valve mechanism. Such valves thus allow for controlled communication between the tubing and the casing annulus surrounding the tubing at the various zone levels at which the sidepocket mandrels are installed. Thus, for example, a sidepocket mandrel may be provided with an orifice injection valve for the injection of water, corrosion inhibitors or other materials into the various zones of injection wells. Similarly, gas lift valves may be installed in the sidepocket mandrels in producing wells so as to carry out conventional gas lift methods.

A wireline running tool is usually employed to install a valve in a sidepocket mandrel. The running tool attached to the wireline is used to lower the valve into a sidepocket mandrel, and a latch mechanism is provided on the valve to lock the valve into place in the mandrel.

When it is subsequently desired to remove a valve from a sidepocket mandrel, a wireline is again run into the well to the level of the valve. A pulling tool attached to the end of the wireline is then used to secure the end of the valve latch. An upward jarring on the wireline then shears a pin in the latch mechanism, thereby releasing the valve from the sidepocket mandrel and allowing it to be removed by the wireline from the well.

Typically, sidepocket mandrels are formed of a metal alloy. Thus, for example, the mandrel's valve receiving pocket is often machined separately and then welded into the side of a tube to form the sidepocket mandrel. Alternatively, the lower portion of the mandrel including the valve receiving pocket may be machined as a single unit and then welded to a tube forming the upper portion of the mandrel.

There are several significant disadvantages with this prior art mandrel construction. For example, the need to weld separate metal components together weakens the mandrel body. Frequently, the mandrel body will begin to leak along the weld seams, thereby interfering with the operation of the mandrel.

One of the most significant problems associated with the prior art mandrels is their susceptibility to corrosion. As a result of corrosion, holes may be formed in the mandrel which make the mandrel unable to function effectively in the well. Consequently, the well installation eventually fails.

When a well installation fails, as described above, it is necessary to remove the defective parts from the well structure. However, due to scale (iron sulfide) build up and the accumulation of other minerals on metal parts, the mandrel and other well components typically cannot be retrieved at once. This necessitates multiple fishing operations which can be very time consuming and expensive.

In an attempt to avoid the significant time and expense of retrieving components from a failed well, one may simply try to destroy the failed well components in place. The use of metal components, however, renders even this procedure somewhat time consuming and expensive. Moreover, the drilling of metal components often damages the casing of the well which may render the well entirely useless.

BRIEF SUMMARY AND OBJECTS OF THE INVENTION

In view of the foregoing, it is a primary object of the present invention to provide a sidepocket mandrel apparatus and method which substantially resists corrosion, thereby significantly lengthening the useful life of the mandrel.

It is a further object of the present invention to provide a sidepocket mandrel apparatus formed without the need for welding adjacent component parts.

It is also an object of the present invention to provide a sidepocket mandrel which may be drilled up in situ after use without damaging the well casing.

Consistent with the foregoing objects, and in accordance with the invention as embodied and broadly described herein, a sidepocket mandrel apparatus is disclosed in one embodiment of the present invention as including a mandrel body formed of a resin-based material, such as, for example, fiberglass. The mandrel body defines a through-bore and an enlargement axially offset from the through-bore. A valve receiving pocket formed of a rigid material is secured within the offset enlargement of the mandrel body so as to be substantially parallel to but axially offset from said through-bore. Such pocket may, for example, be formed of stainless steel or of a composite plastic material.

In accordance with the present invention, the sidepocket mandrel is formed by machining a valve receiving pocket from a rigid material. The valve receiving pocket is removably secured on a substantially cylindrical molding rod, together with at least one removable mold piece, the molding rod and removable mold pieces defining the desired inner shape of the sidepocket mandrel. Fiberglass is then wound around the valve receiving pocket, molding rod, and removable mold pieces to form a fiberglass mandrel body. The molding rod and mold pieces are removed from the fiberglass mandrel body, the fiberglass is cured, and the fiberglass is thereafter machined to form threads adjacent each end of the mandrel body.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENT

It will be readily understood that the components of the present invention, as generally described and illustrated in the Figures herein, could be arranged and designed in a wide variety of different configurations. Thus, the following more detailed description of the embodiments of the apparatus and methods of the present invention, as represented in FIGS. 1 through 8, is not intended to limit the scope of the invention, as claimed, but it is merely representative of the presently preferred embodiment of the invention.

The presently preferred embodiment of the invention will be best understood by reference to the drawings, wherein like parts are designated by like numerals throughout.

Figure 1:
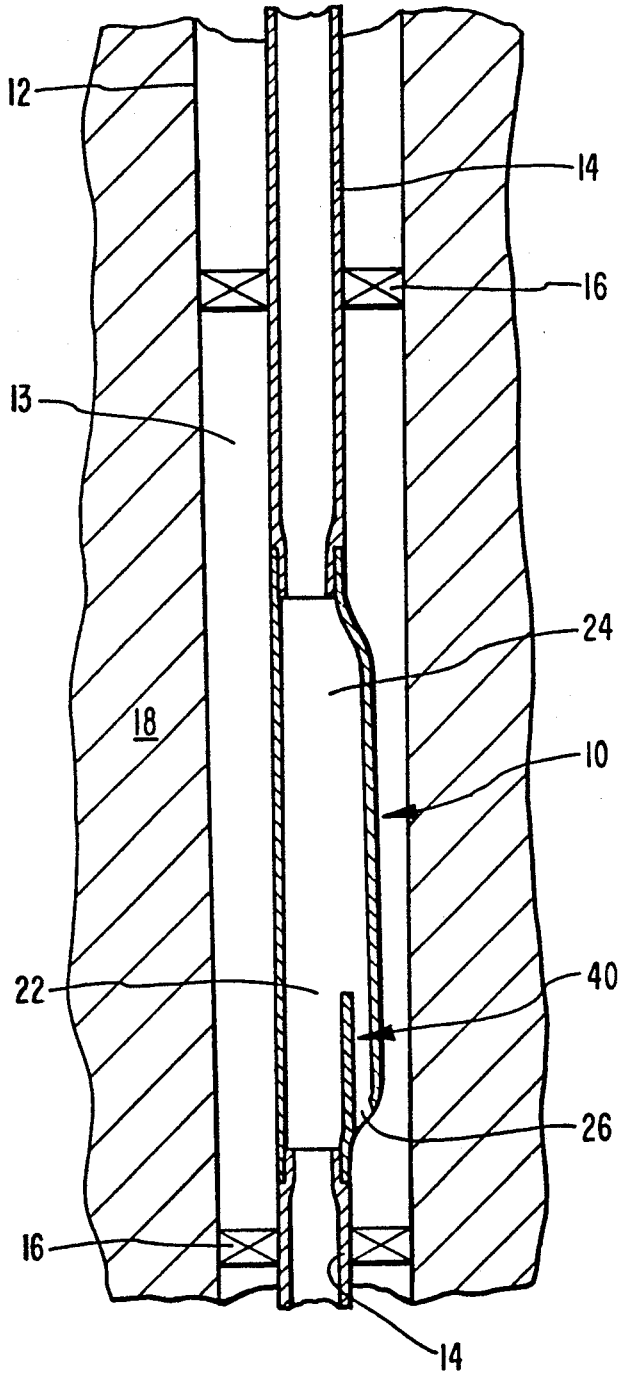
FIG. 1 is cross-sectional schematic illustration showing one presently preferred embodiment of the sidepocket mandrel of the present invention as it would be installed in the tubing string of well.

The sidepocket mandrel of the present invention, designated generally at 10, is illustrated in FIG. 1 as it might be used in a typical well installation. Casing 12 of the well extends into the earth 18. A string of tubing 14 extends the length of the well inside casing 12, with different zones along the well depth being isolated by means of packers 16.

Figure 3:
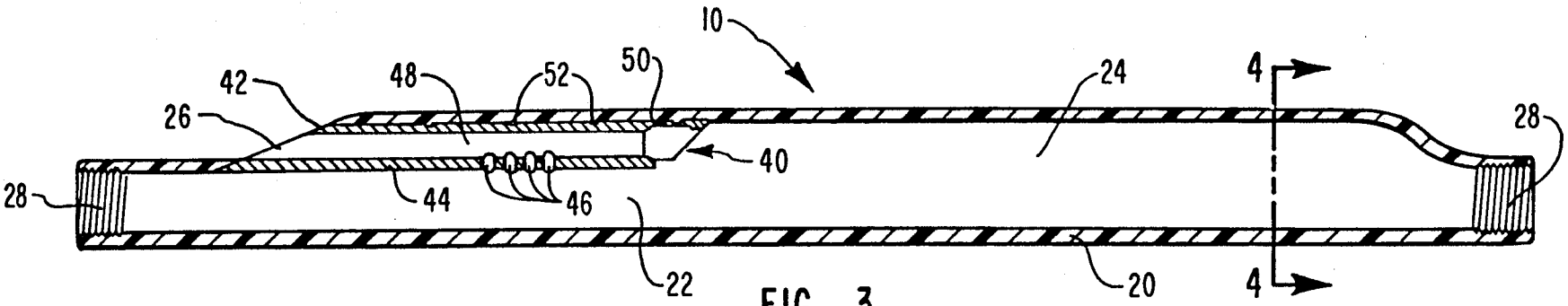
FIG. 3 is a lengthwise, cross-sectional view of one presently preferred embodiment of the sidepocket mandrel of the present invention.
Figure 4:
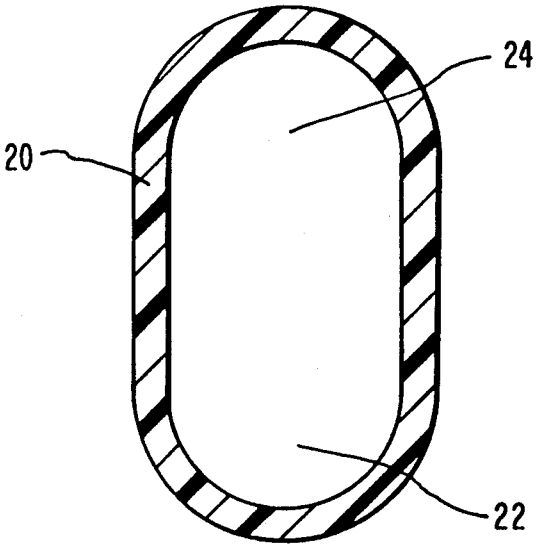
FIG. 4 is a vertical cross-sectional view taken along lines 4—4 of FIG. 3.

Sidepocket mandrel 10 is installed between two lengths of tubing 14. As also depicted in FIGS. 3 and 4, the body of the sidepocket mandrel defines an open through-bore 22 in alignment with the bore through tubing 14. In addition, the body of sidepocket mandrel 10 defines an axially offset enlargement 24 in which is secured a valve receiving pocket 40. Valve receiving pocket 40 is provided with a suitable outlet port 26, and a valve (not shown) placed within pocket 40 may thus control fluid communication between the through-bore 22 of sidepocket mandrel 10 and the annulus region 13 inside casing 12.

When used in gas lift applications, for example, a gas lift valve is installed in pocket 40 of sidepocket mandrel 10. Oil or gas is then produced through tubing 14 in conventional fashion.

Alternatively, sidepocket mandrel 10 may receive an orifice injection valve in pocket 40 when used in an injection well construction. Various fluids may then be selectively injected into the well through sidepocket mandrel 10.

Significantly, as described further below, sidepocket mandrel 10 is formed in substantial part of a relatively soft, non-metal material. As a result, in the event the well installation fails, sidepocket mandrel 10 can easily be destroyed in situ by drilling without damaging the well casing 12.

Figure 2:
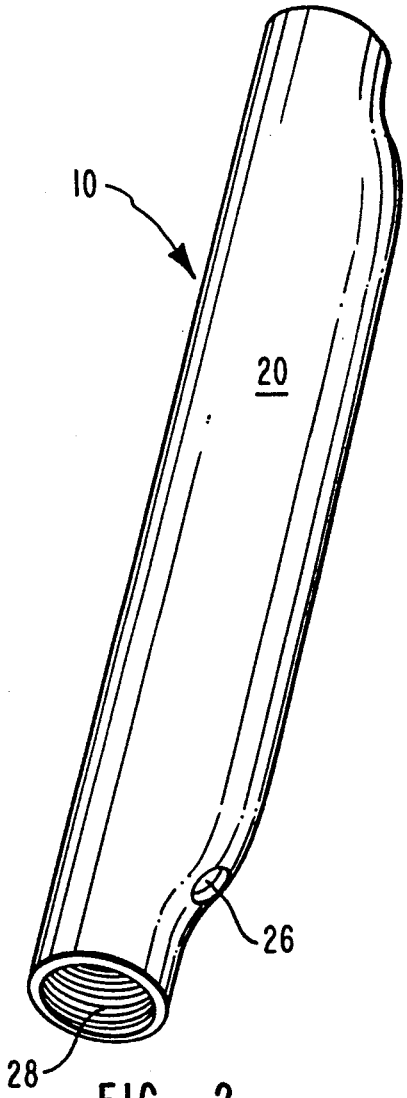
FIG. 2 is a perspective view of one presently preferred embodiment of the sidepocket mandrel of the present invention.

Referring now more particularity to FIGS. 2 through 4, sidepocket mandrel 10 comprises a mandrel body 20 having threaded ends 28 for use in securing sidepocket mandrel 10 to a tubing string. Enlargement 24, which is axially offset from through-bore 22, is formed as an integral part of mandrel body 20. As described herein, mandrel body 20 is preferably formed as a unitary structure, thereby obviating the need for welds and seams.

Mandrel body 20 may be formed in virtually any shape consistent with the present invention. For example, mandrel body 20 might be substantially circular in cross sectional shape. Alternatively, as shown best in FIG. 4, mandrel body 20 may have an oval shape.

Mandrel body 20 is formed in accordance with the present invention of a soft, non-metal, drillable material. Thus, for example, mandrel body 20 may be formed of a resin-based material, such as, for example, fiberglass.

A valve receiving pocket 40 is secured within the offset enlargement 24 of mandrel body 20. As shown best in FIGS. 5 and 6, the outside surface of pocket 40 is formed so as to conform substantially to the desired inner shape of mandrel body 20. In addition, the surface 44 of pocket 40 which lies adjacent the through-bore 22 in mandrel body 20 has a arcuate configuration, for reasons which will become more readily apparent from the discussion which follows.

Valve receiving pocket 40 is preferably molded into valve body 20 as an integral part of the construction process. Accordingly, pocket 40 may be provided with a plurality of grooves 52 which receive portions of the resin-based material of mandrel body 20. Grooves 52 thus cooperate with mandrel body 20 to secure pocket 40 against longitudinal movement along mandrel body 20.

Figure 7:
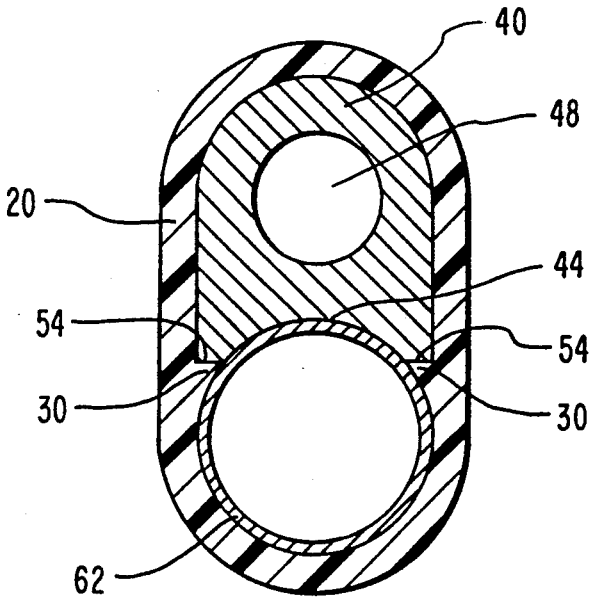
FIG. 7 is a vertical cross-sectional view taken along lines 7—7 of FIG. 6.

In accordance with the presently preferred embodiment, as depicted in FIG. 7, valve receiving pocket 40 may also include substantially planar surfaces 54 which lie substantially perpendicular to adjacent portions of mandrel body 20. Consequently, during manufacture, the resin-based material of mandrel body 20 extends across and engages planar surfaces 54 as depicted at 30, thereby retaining pocket 40 in place within the axially offset enlargement portion 24 of mandrel body 20.

It will be appreciated that other suitable means may be employed to secure pocket 40 within mandrel body 20. Thus, while valve receiving pocket 40 is preferably molded directly into mandrel body 20 during manufacture, as described above, pocket 40 may, alternatively, be secured within mandrel body 20 by means of appropriate hardware.

Referring again to FIG. 5, valve receiving pocket 40 also preferably includes a sloped end surface 42. The slope of surface 42 helps to minimize scale and mineral accumulation.

With particular reference to FIG. 3 and 7, the inside of valve receiving pocket 40 is formed so as to accept appropriate flow control valves. Thus, for example, pocket 40 has an internal bore 48 which acts as a valve seat. Bore 48 may, of course, be formed so as to accept any suitable size control valve, such as, for example, valves having a nominal diameter of one inch (2.54 cm).

Valve receiving pocket 40 is also formed with appropriate fluid flow orifices. Thus, as depicted in FIG. 3, surface 44 of pocket 40 may include appropriate inlet ports 46, and an outlet port may be provided from pocket 40 at 26.

Importantly, valve receiving pocket 40 is formed so as to cooperate with the latch mechanisms of the flow control valves. Thus, for example, end 50 of pocket 40 may be formed so as to receive conventional collet or ring top latches.

Valve receiving pocket 40 is formed of a rigid material which is sufficiently strong to withstand the shear forces attending repeated installation and retrieval of flow control valves. The material forming pocket 40 must also be able to withstand the heat which is necessary to cure the resin-based material forming mandrel body 20. Pocket 40 must also be able to withstand exposure to carbon dioxide and well fluids, and the material forming pocket 40 preferably also has a similar coefficient of expansion as the resin-based material of mandrel body 20.

Pocket 40 may, accordingly, be formed of stainless steel. Significantly, although it would be unrealistically expensive to manufacture sidepocket mandrel 10 entirely from stainless steel, forming pocket 40 of stainless steel is not cost prohibitive. Thus, for example, pocket 40 may be formed of grade of 316 stainless steel which is highly resistant to corrosion.

Alternatively, pocket 40 may be formed of a plastic coated steel. Pocket 40 might also be formed with steel ends 26 and 50, with other portions of pocket 40 being formed of other suitable materials. Valve receiving pocket 40 might also be formed of a hard plastic composite material.

Figure 5:
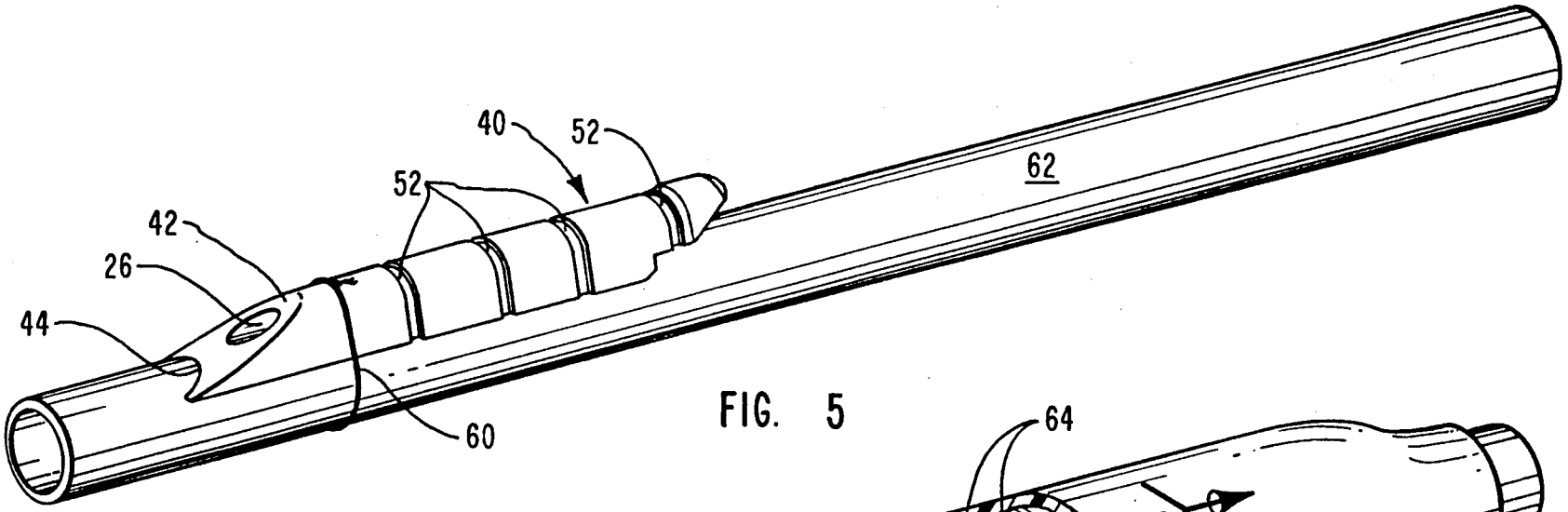
FIG. 5 is a perspective view showing one presently preferred embodiment of the valve receiving pocket of the sidepocket mandrel attached to a molding rod.
Figure 6:
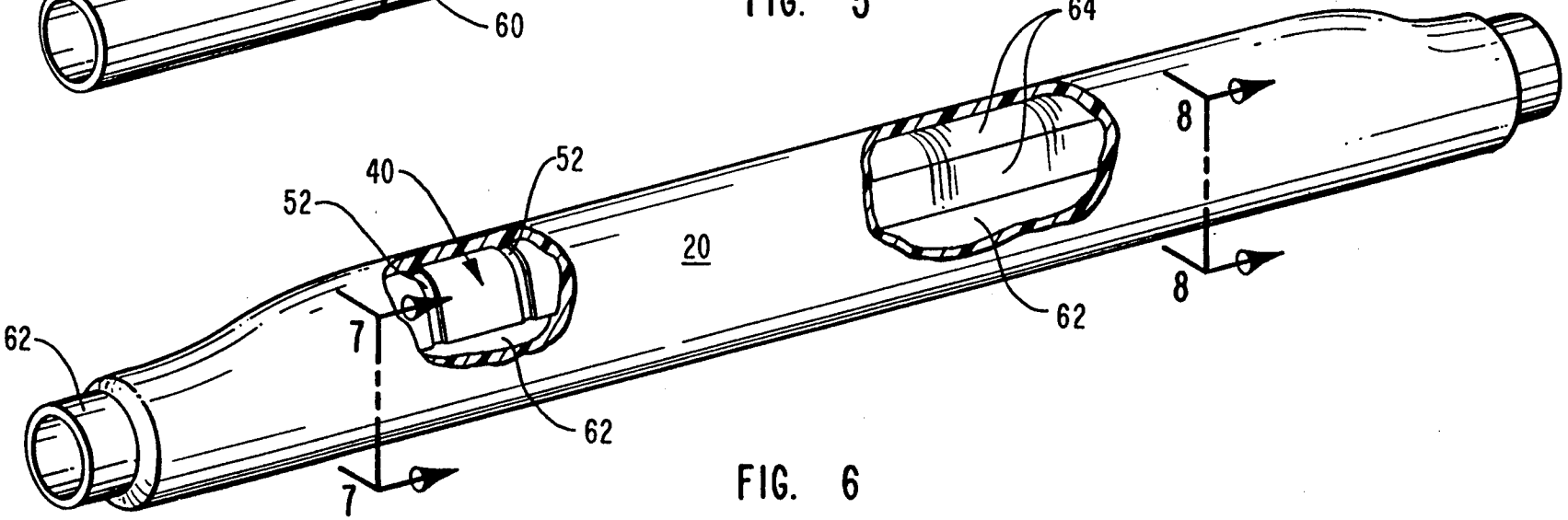
FIG. 6 is a perspective view showing the valve receiving pocket, molding rod, and removable mold pieces wound with a resin-based material, portions of the resin-based material being broken away to reveal internal components.

In producing sidepocket mandrel 10 of the present invention, valve receiving pocket 40 is first machined in accordance with the foregoing description. Then, as depicted in FIG. 5, pocket 40 is removably secured on a substantially cylindrical molding rod 62. Molding rod 62 may be formed of any suitable material, such as, for example, aluminum, and may be either hollow or solid. As illustrated, pocket 40 may be secured on molding rod 62 by means of one or more wires 60.

One or more removable mold pieces 64 are then also secured on rod 62. Importantly, mold pieces 64, in combination with molding rod 62, conform to the desired internal shape of mandrel body 20.

Removable mold pieces 64 may be formed of any suitable material. Thus, for example, mold pieces 64 might be formed of a rigid, metal material, such as, for example, aluminum. In such case, as illustrated in FIG. 8, there may be four cooperating mold pieces 64 which rest on molding rod 62.

Figure 8:
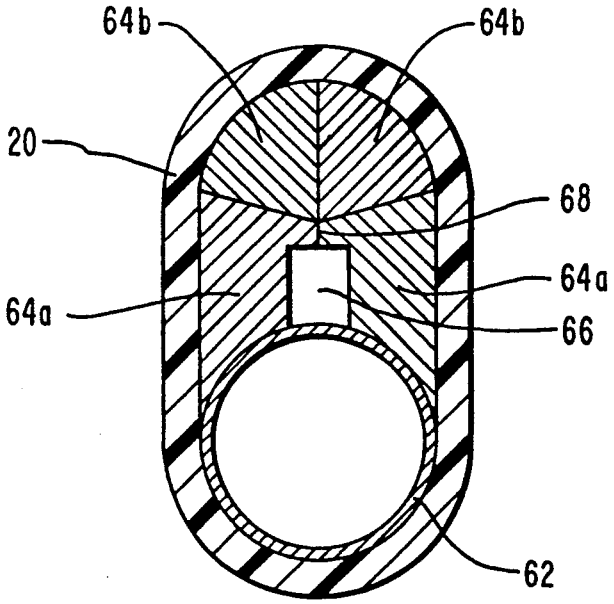
FIG. 8 is a vertical cross-sectional view taken along lines 8—8 of FIG. 6.

Referring to FIG. 8, a keyway 66 is preferably formed in the mold pieces **64*a* which rest directly on molding rod 62. This construction minimizes the length of surface contact between pieces 64*a* at 68 and thereby greatly facilitates the subsequent removal of mold pieces 64 from mandrel body 20**.

Removable mold pieces 64 might also be formed in other suitable ways. For example, mold pieces 64 might comprise one or more inflatable members which can be subsequently deflated and removed from mandrel body 20.

Mold pieces are removably secured to molding rod 20 in some suitable fashion. For example, molding pieces 64 might be secured to molding rod 62 by means of a wire. Alternatively, molding pieces may be coated with wax to thereby assist in securing mold pieces 64 to molding rod 62 and also facilitating subsequent removal thereof.

With valve receiving pocket 40 and mold pieces 64 thus in place on molding rod 62, the structure is wound with fiberglass to form mandrel body 20. Importantly, in the process of winding fiberglass around valve receiving pocket 40 and molding rod 62, wire 60 is removed.

With the fiberglass in place, molding rod 62 is removed from mandrel body 20. Mandrel body 20 may then be tapped with a mallet so as to dislodge removable mold pieces 64. Mold pieces 64 are likewise removed from mandrel body 20.

Mandrel body 20 may then be cured by means of baking in conventional fashion. Thereafter, a hole may be drilled for outlet port 26 (see FIG. 2), and threads may be machined in ends 28 of mandrel body 20 using a conventional diamond wheel. Sidepocket mandrel 10 is now ready for installation in a well.

From the above discussion, it will be appreciated that the present invention provides a sidepocket mandrel apparatus and method which substantially resists corrosion, thereby significantly lengthening the useful life of the mandrel. The present invention also provides a sidepocket mandrel apparatus formed without the need for welding adjacent component parts. Further, because the mandrel body is formed of a resin-based material such as fiberglass, the present invention provides a sidepocket mandrel which may be drilled up in situ after use without damaging the well casing.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A sidepocket mandrel apparatus, comprising:

a mandrel body formed of a resin-based material, the mandrel body defining a through-bore and an enlargement axially offset from the through-bore; and a valve receiving pocket formed of a rigid material and secured within the offset enlargement of the mandrel body so as to be substantially parallel to but axially offset from said through-bore.

2. A sidepocket mandrel apparatus as defined in claim 1 wherein the mandrel body has a substantially oval cross-sectional shape.

3. A sidepocket mandrel apparatus as defined in claim 1 wherein the mandrel body is formed of fiberglass.

4. A sidepocket mandrel apparatus as defined in claim 1 wherein the mandrel body is formed as a substantially unitary structure.

5. A sidepocket mandrel apparatus as defined in claim 1 wherein the valve receiving pocket is at least partially formed of stainless steel.

6. A sidepocket mandrel apparatus as defined in claim 1 wherein the valve receiving pocket is formed of a composite plastic material.

7. A sidepocket mandrel apparatus as defined in claim 1 wherein the valve receiving pocket has at least one groove therein and is secured within the offset enlargement of the mandrel body by portions of the resin-based material of the mandrel body which are received within said grooves.

8. A sidepocket mandrel apparatus as defined in claim 1 wherein the valve receiving pocket has at least one planar surface which lies substantially perpendicular to an adjacent portion of the mandrel body, and wherein the valve receiving pocket is secured within the offset enlargement of the mandrel body by portions of the resin-based material which extend across and engage said planar surface.

9. A sidepocket mandrel apparatus as defined in claim 1 wherein the valve receiving pocket has a first fluid port communicating directly with the through-bore and a second fluid port communicating through the mandrel body.

10. A sidepocket mandrel apparatus, comprising:

a mandrel body formed of a fiberglass material, the mandrel body defining a substantially linear through-bore and an enlargement axially offset from the through-bore; and a valve receiving pocket formed of a rigid material and secured within the offset enlargement of the mandrel body so as to be substantially parallel to but axially offset from said through-bore.

11. A sidepocket mandrel apparatus as defined in claim 10 wherein the valve receiving pocket is formed of stainless steel.

12. A sidepocket mandrel apparatus as defined in claim 10 wherein the valve receiving pocket is formed of a composite plastic material.

13. A sidepocket mandrel apparatus as defined in claim 10 wherein the valve receiving pocket has at least one groove therein and is secured within the offset enlargement of the mandrel body by portions of the fiberglass material of the mandrel body which are received within said grooves.

14. A sidepocket mandrel apparatus as defined in claim 13 wherein the valve receiving pocket has at least one planar surface which lies substantially perpendicular to an adjacent portion of the mandrel body, and wherein the valve receiving pocket is secured within the offset enlargement of the mandrel body by portions of the fiberglass material which extend across and engage said planar surface.

15. A method for producing a sidepocket mandrel, the method comprising the steps of:

machining a valve receiving pocket from a rigid material;

removably securing the valve receiving pocket on a substantially cylindrical molding rod;

securing at least one removable mold piece on the molding rod adjacent the valve receiving pocket, said molding rod and removable mold pieces defining a desired inner shape of the sidepocket mandrel;

winding fiberglass around the valve receiving pocket, molding rod, and removable mold pieces to form a fiberglass mandrel body;

removing the molding rod and mold pieces from the fiberglass mandrel body;

curing the fiberglass; and machining the fiberglass to form threads adjacent each end of the mandrel body.

16. A method for producing a sidepocket mandrel as defined in claim 15 wherein the step of removably securing the valve receiving pocket on a substantially cylindrical molding rod comprises fastening the pocket to the molding rod with wire.

17. A method for producing a sidepocket mandrel as defined in claim 16 wherein the fiberglass winding step comprises removing the wire fastening the valve receiving pocket to the molding rod.

18. A method for producing a sidepocket mandrel as defined in claim 15 wherein the step of securing at least one removable mold piece on the molding rod comprises positioning the mold pieces on the molding rod so as to define a keyway between the mold pieces and the molding rod directly adjacent the molding rod.

19. A method for producing a sidepocket mandrel as defined in claim 15 wherein the removable mold pieces are formed of a rigid material and wherein the step of securing at least one removable mold piece on the molding rod comprises coating the removable mold pieces with wax.

20. A method for producing a sidepocket mandrel as defined in claim 15 wherein the step of removing the molding rod and mold pieces from the fiberglass mandrel body comprises the steps of:

removing the molding rod from the mandrel body;

tapping the mandrel body so as to jar loose the removable mold pieces; and removing the mold pieces from mandrel body.

21. A method as defined in claim 15, further comprising the steps of:

installing the sidepocket mandrel in a well tubing string; and removing the sidepocket mandrel from the tubing string by drilling up the sidepocket mandrel.

* * * * *